US005926073A

United States Patent [19]

Hasegawa et al.

[11] Patent Number: 5,926,073

[45] Date of Patent: Jul. 20, 1999

[54] NONRECIPROCAL CIRCUIT DEVICE COMPRISING FIRST AND SECOND FERROMAGNETIC BODIES HAVING DIFFERENT SATURATION MAGNETIZATIONS

[75] Inventors: Takashi Hasegawa, Ishikawa-ken; Hiroshi Marusawa, Moriyama, both of Japan

[73] Assignee: Murata Manufacturing Co., Ltd., Japan

[21] Appl. No.: 08/969,385

[22] Filed: Nov. 13, 1997

[30] Foreign Application Priority Data

Nov. 14, 1996 [JP] Japan ..... 8-303196

[51] Int. Cl.[6] ..... H01P 1/383

[52] U.S. Cl. ..... 333/1.1; 333/24.2

[58] Field of Search ..... 333/1.1, 24.2

[56] References Cited

U.S. PATENT DOCUMENTS

| | | | |
|---|---|---|---|
| 4,496,915 | 1/1985 | Mathew et al. | 333/1.1 |
| 5,498,999 | 3/1996 | Marusawa et al. | 333/1.1 |
| 5,786,736 | 7/1998 | Dejima et al. | 333/1.1 |

FOREIGN PATENT DOCUMENTS

| | | |
|---|---|---|
| 0664573 | 7/1995 | European Pat. Off. . |
| 7137534 | 6/1972 | France . |
| 1359175 | 7/1974 | United Kingdom . |

OTHER PUBLICATIONS

Patent Abstracts of Japan, vol. 6, No. 144 (E–122), Aug. 3, 1982 & JP 57 067308 A (Hitachi Metals Ltd), Apr. 23, 1982, abstract.

S. Lenz et al.: "A New Type of Drop–In Microstrip Circulator on Soft Substrate Materials", 15th European Microwave Conference Proceedings, Sep. 9–13, 1985, Paris (FR), pp. 802–807, XP002055954, p. 803, line 2–line 23; figures 4,5.

Webb D C: "Design and Fabrication of Low–Cost Ferrite Circulators" Proceedings of the 25th European Microwave Conference 1995, Bologna, Sep. 4–7, 1995, vol. vol. 2, No. Conf. 25, Sep. 4, 1995, European Microwave Conference Committee, pp. 1191–1200, XP000681870 *p. 1195, left–hand column, line 10–line 22, figure 6.

C.P. Hartwig et al.: "Ferrite Film Circulator" Journal of Applied Physics, vol. 41, No. 3, Mar. 1, 1970, New York, U.S., pp. 1351–1352, XP002055955, whole document.

European Search Report dated Mar. 3, 1998.

*Primary Examiner*—Paul Gensler

*Attorney, Agent, or Firm*—Ostrolenk, Faber, Gerb & Soffen, LLP

[57] ABSTRACT

A nonreciprocal circuit device with a simplified manufacturing process and a reduced manufacturing cost, without any increase in the magnetic material loss in a matching circuit. The nonreciprocal circuit device has an integrally fired ferromagnetic body formed of a first ferromagnetic body and a second ferromagnetic body. In the first ferromagnetic body, central conductors are arranged to cross each other in an electrically isolated state. In the second ferromagnetic body having lower saturation magnetization than that of the first ferromagnetic body, capacity electrodes and earth electrodes are formed to form the matching circuit.

6 Claims, 7 Drawing Sheets

NONRECIPROCAL CIRCUIT DEVICE COMPRISING FIRST AND SECOND FERROMAGNETIC BODIES HAVING DIFFERENT SATURATION MAGNETIZATIONS

BACKGROUND OF THE INVENTION

1. Field of the Invention

The present invention relates to a nonreciprocal circuit device for use in a mobile communications apparatus such as a portable telephone, etc., and particularly to a nonreciprocal circuit device used as a circulator or an isolator in a high frequency band such as the microwave band or the like.

2. Description of the Related Art

Recently in mobile communications, high frequency apparatus has increasingly been miniaturized and generalized, and it has also been strongly demanded to decrease the size and cost of a nonreciprocal circuit device used in such apparatus.

A known nonreciprocal circuit device is, for example, a device comprising a plurality of central electrodes arranged to cross each other in an electrically isolated state, microwave magnetic materials provided above and below the plurality of central electrodes, and a permanent magnet for applying a DC magnetic field to the plurality of central electrodes, i.e., a lumped-parameter nonreciprocal circuit device. Such a lumped-parameter nonreciprocal circuit device is used as, for example, a circulator or an isolator.

FIG. 1 is an exploded perspective view showing an example of a conventional circulator. In this circulator, in order to decrease the size thereof, a plurality of central conductors are arranged in a ferromagnetic body 1 to cross each other in an electrically isolated state. Namely, as shown in an exploded perspective view of FIG. 2, the ferromagnetic body 1 has a laminated structure comprising a plurality of ferromagnetic material layers 1*a* to 1*e*. On the upper sides of the ferromagnetic material layers 1*b*, 1*c* and 1*d* are formed central conductors 2*a* and 2*b*, 2*c* and 2*d* and 2*e* and 2*f*, respectively. In other words, on the upper side of each of the ferromagnetic material layers 1*b* to 1*d* are arranged a pair of central conductors.

The central conductors 2*a* and 2*b*, the central conductors 2*c* and 2*d*, and the central conductors 2*e* and 2*f* are arranged to cross each other in a laminated state, and are electrically isolated by the ferromagnetic material layers 1*c* and 1*d*.

On the ferromagnetic material layers 1*a* and 1*e* are formed earth electrodes 3*a* and 3*b*, respectively.

In the ferromagnetic body 1 shown in FIG. 1, external electrodes 4*a*, 4*b* and 4*c* are formed on the side thereof so as to be connected to the earth electrodes 3*a* and 3*b* in common, and each external electrode being electrically connected to the ends of one of the pairs of central conductors 2*a*–2*f*.

In FIG. 1, to the upper side of the ferromagnetic body 1 is fixed a dielectric body 5. The dielectric body 5 comprises dielectric ceramic and has a capacitor provided therein for forming a matching circuit. Namely, as shown in an exploded view of FIG. 3, the dielectric body 5 has a laminated structure comprising dielectric layers 5*a* and 5*b*. On the upper side of the dielectric layer 5*a* are formed capacity electrodes 6*a*, 6*b* and 6*c*. On the upper side of the dielectric layer 5*b* is formed an earth electrode 7. Therefore, in each portion where the capacity electrodes 6*a* to 6*c* are overlapped with the earth electrode 7 and the earth electrode 3*b* through the dielectric layers 5*b* and 5*a*, respectively, a capacitor is formed.

In FIG. 1, external electrodes 8*a*, 8*b* and 8*c* are formed on the side of the dielectric body 5. Each of these external electrodes 8*a* to 8*c* is electrically connected to one of the capacity electrodes or one of the earth electrodes.

On the other hand, the ferromagnetic body 1 and the dielectric body 5 are contained in a terminal plate 9 having a cylindrical concave 9*a* at the center thereof. In the terminal plate 9 are formed conductor patterns 10*a* to 10*c* which constitute input/output terminals, and conductive patterns 10*d*, 10*e* and 10*f* which are connected to the earth potential.

The external electrodes 4*a* to 4*c* formed on the side of the ferromagnetic body 1 and the external electrodes 8*a* to 8*c* formed on the side of the dielectric body 5 are contained in the concave 9*a* of the terminal plate 9 and appropriately connected to the conductive patterns 10*a* to 10*f*.

In FIG. 1, a permanent magnet 11 is provided for applying a magnetic field to a portion in the ferromagnetic body 1 where the central conductors cross each other. The nonreciprocal circuit device shown in FIG. 1 further comprises metallic yokes 12 and 13. The terminal plate 9 and the magnet 11 are held between the yokes 12 and 13. The yokes 12 and 13 constitute a magnetic circuit for applying a magnetic field together with the magnet 11.

In the nonreciprocal circuit device shown in FIGS. 1 to 3, since the portion where the plurality of central conductors 2*a*, 2*b* to 2*e* and 2*f* cross each other in an electrically isolated state is integrally formed by using the ferromagnetic body 1, the nonreciprocal circuit device can easily be manufactured, and miniaturized.

However, since the ferromagnetic body 1 and the dielectric body 5 are separately fired and then joined together, the external electrodes 4*a* to 4*c* and the external electrodes 8*a* to 8*c* on the sides thereof must be electrically connected by soldering or the like. Therefore, the number of the connection points is increased, and thus, a problem occurs with respect to insufficient reliability. Also, since the ferromagnetic body 1 and the dielectric body 5 are fired separately, a plurality of firing steps must be carried out, and a troublesome assembly process is required, thereby making it difficult to reduce the manufacturing cost.

Therefore, the above problems can be possibly solved by simultaneously firing the ferromagnetic body 1 and the dielectric body 5. Namely, the above problems can be possibly solved by a method in which a green sheet for forming the ferromagnetic body 1 and a green sheet for forming the dielectric body 5 are laminated and simultaneously fired.

However, firing conditions for the ferromagnetic body 1 and the dielectric body 5 are different, and thus firing under conditions suitable for one of the bodies causes the possibility that firing of the other does not sufficiently proceed. Also firing under conditions intermediate between the conditions for both bodies causes a problem in that both the ferromagnetic body 1 and the dielectric body 5 may not be properly fired.

In addition, even if the ferromagnetic body 1 and the dielectric body 5 can be simultaneously fired, it is still not possible to use the same line in the step of preparing raw materials, thereby causing difficulties in decreasing the manufacturing cost.

Therefore, as a method of solving the above problems, a method has been proposed in which a central conductor arrangement portion and a capacitor formation portion for forming a matching circuit are formed in the same ferromagnetic body. This method will be described with reference to FIGS. 4 and 5.

FIG. 4 is an exploded perspective view illustrating another example of a conventional nonreciprocal circuit device. In the ferromagnetic body 15 shown in FIG. 4, a plurality of central conductors and a matching circuit are arranged. The electrode structure in the ferromagnetic body 15 is shown in an exploded perspective view of FIG. 5.

In the ferromagnetic body 15, ferromagnetic layers 15*a* to 15*e* are laminated. On the upper sides of the ferromagnetic layers 15*b* to 15*d* are formed a plurality of central conductors 16*a*, 16*b* to 16*e* and 16*f*, like the case of the ferromagnetic body 1 shown in FIG. 2. In this structure, ends of the central conductors 16*a* and 16*b* on the upper surface of the ferromagnetic layer 15*b* are electrically connected to a capacity electrode 17*a*. Similarly, ends of the central conductors 16*c* and 16*d* on the upper side of the ferromagnetic layer 15*c* are connected to a capacity electrode 17*b* formed thereon, and ends of the central conductors 16*e* and 16*f* on upper side of the ferromagnetic layer 15*d* are electrically connected to a capacity electrode 17*c* formed thereon.

On the upper sides of the ferromagnetic layers 15*a* and 15*e* are formed earth electrodes 18*a* and 18*b*, respectively. Therefore, in the ferromagnetic material 15 formed by laminating the ferromagnetic layers 15*a* to 15*e* and integrally firing the layers, not only the plurality of central conductors 16*a* to 16*f* are arranged, but also the capacity electrodes 17*a* to 17*c* for forming a matching circuit are arranged. The capacity electrodes 17*a* to 17*c* are overlapped with the earth electrodes 18*a* and 18*b* to form capacitors.

Referring to FIG. 4, the ferromagnetic body 15 is inserted into a concave 9*a* of a terminal plate 9 with a permanent magnet 11 disposed thereon, and held between metallic yokes 12 and 13 to form a nonreciprocal circuit device.

The nonreciprocal circuit device shown in FIG. 4 comprises the portion where the plurality of central conductors are arranged by using the ferromagnetic body 15, and the matching circuit. Therefore, the assembly step can be simplified, and the manufacturing cost can be decreased because a plurality of lines need not be used in the raw material preparing step. Also, since there is no need for joining the central conductors and the matching circuit by soldering or the like, the reliability can be improved.

However, since the capacitors for forming the matching circuit are formed by the ferromagnetic body 15, it is possible that a loss in the matching circuit may be increased due to the magnetic loss of the ferromagnetic body, whereby the insertion loss of the nonreciprocal circuit device may be increased.

SUMMARY OF THE INVENTION

The present invention is able to remove the above faults of the prior art, and provide a nonreciprocal circuit device with excellent reliability which permits reduction in its size and simplification of its manufacturing process without deterioration in its properties, such as insertion loss.

In accordance with a broad aspect of the present invention, there is provided a nonreciprocal circuit device comprising a first ferromagnetic body, a plurality of central conductors which are formed in the first ferromagnetic body and which are arranged to cross each other in an electrically isolated state, a second ferromagnetic body fixed to the first ferromagnetic body, and a matching circuit formed in the second ferromagnetic body and electrically connected to the plurality of central conductors, wherein the first and second ferromagnetic bodies have different saturation magnetizations.

In this nonreciprocal circuit device, the first ferromagnetic body and the second ferromagnetic body are integrally formed, the plurality of central conductors are arranged in the first ferromagnetic body, and the matching circuit is provided in the second ferromagnetic body. Thus, the portion where the plurality of central conductors are arranged and the portion where the matching circuit is formed both comprise ferromagnetic bodies, and thus the same line can be used in the raw material preparing step. In addition, since the first and second ferromagnetic bodies have different saturation magnetizations, for example, the magnetic loss can be decreased both when the saturation magnetization of the second ferromagnetic body is smaller than that of the first ferromagnetic body, and when the saturation magnetization of the second ferromagnetic body is larger than that of the first ferromagnetic body.

Further, a magnetic circuit is preferably provided on the first ferromagnetic body in order to apply a DC magnetic field. In this case, since the magnetic circuit for applying a DC magnetic field is integrated with the portion where the central conductors are arranged, the assembly step can further be simplified.

In accordance with a more specific aspect of the present invention, the matching circuit comprises plural pairs of capacity electrodes and earth electrodes which are formed to hold the magnetic layers of the second ferromagnetic body therebetween. In this case, the pairs of capacity electrodes respectively form the capacitors each of which is electrically connected to any one of the plurality of central conductors.

Also the first and second ferromagnetic bodies are preferably integrated by simultaneous firing. Therefore, the step of fixing the first and second ferromagnetic bodies can be omitted, thereby increasing the reliability of the electric connection between the central conductors and the matching circuit.

DETAILED DESCRIPTION OF AN EMBODIMENT OF THE INVENTION

An example of the structure of a nonreciprocal circuit device of the present invention will be described below.

Figure 4:
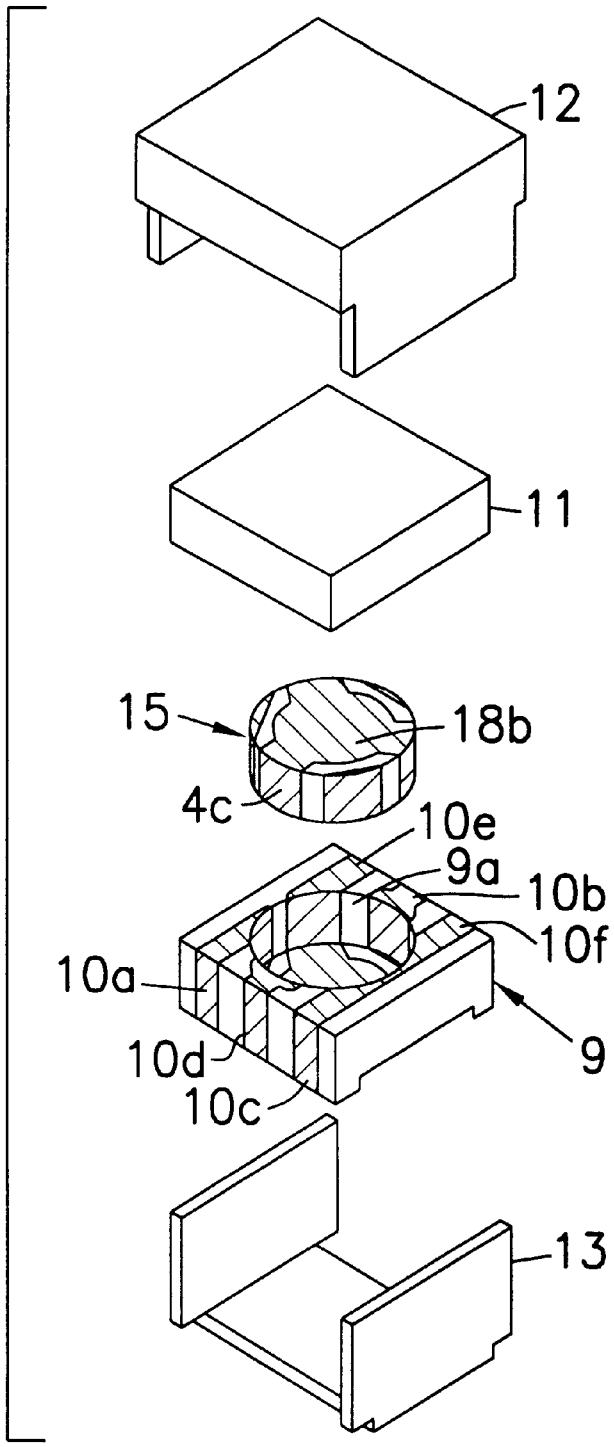
FIG. 4 PRIOR ART
FIG. 4 is an exploded perspective view illustrating another example of a conventional nonreciprocal circuit device.
Figure 5:
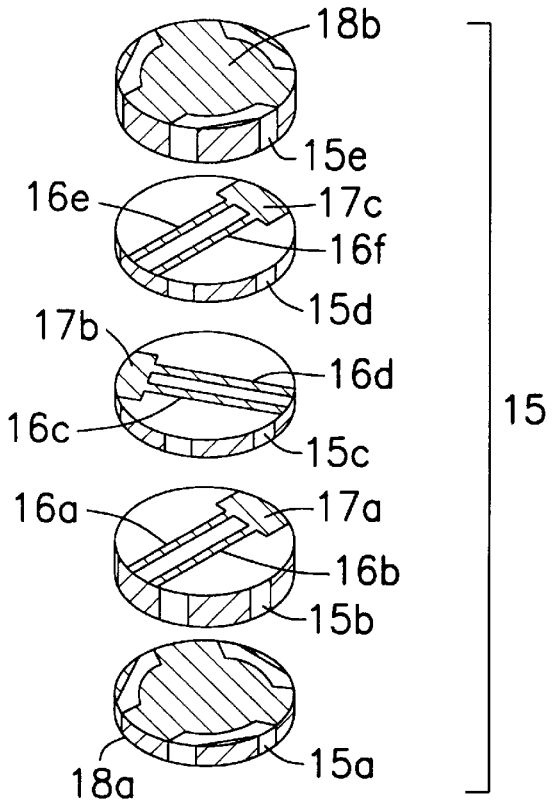
FIG. 5 PRIOR ART
FIG. 5 is an exploded perspective view illustrating the internal structure of the ferromagnetic body in the conventional nonreciprocal circuit device shown in FIG. 4.
Figure 6:
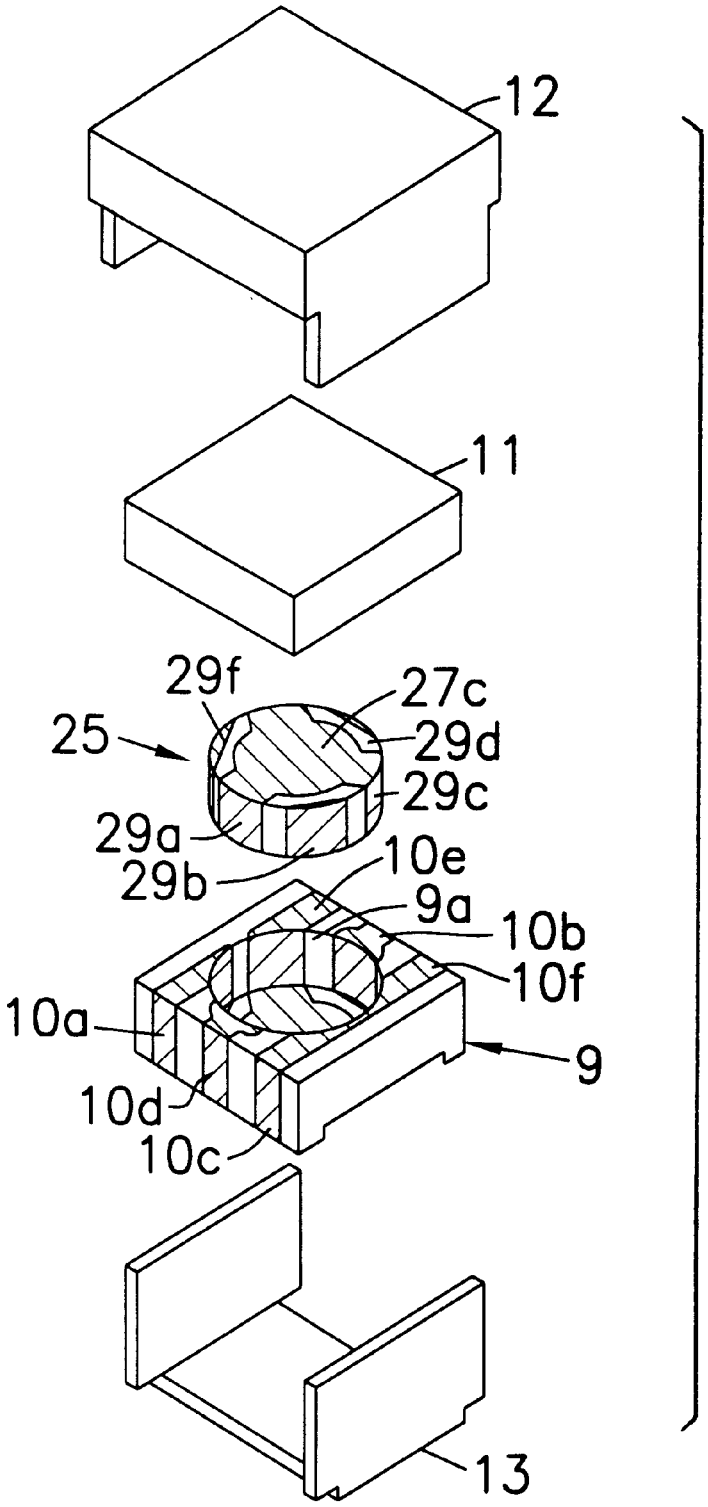
FIG. 6 is an exploded perspective view illustrating a nonreciprocal circuit device in accordance with an embodiment of the present invention.

FIG. 6 is an exploded perspective view of a nonreciprocal circuit device in accordance with an embodiment of the present invention. The construction shown in FIG. 6 is the same as the conventional nonreciprocal circuit device shown in FIG. 4 except for the structure of a ferromagnetic body 25.

Figure 7:
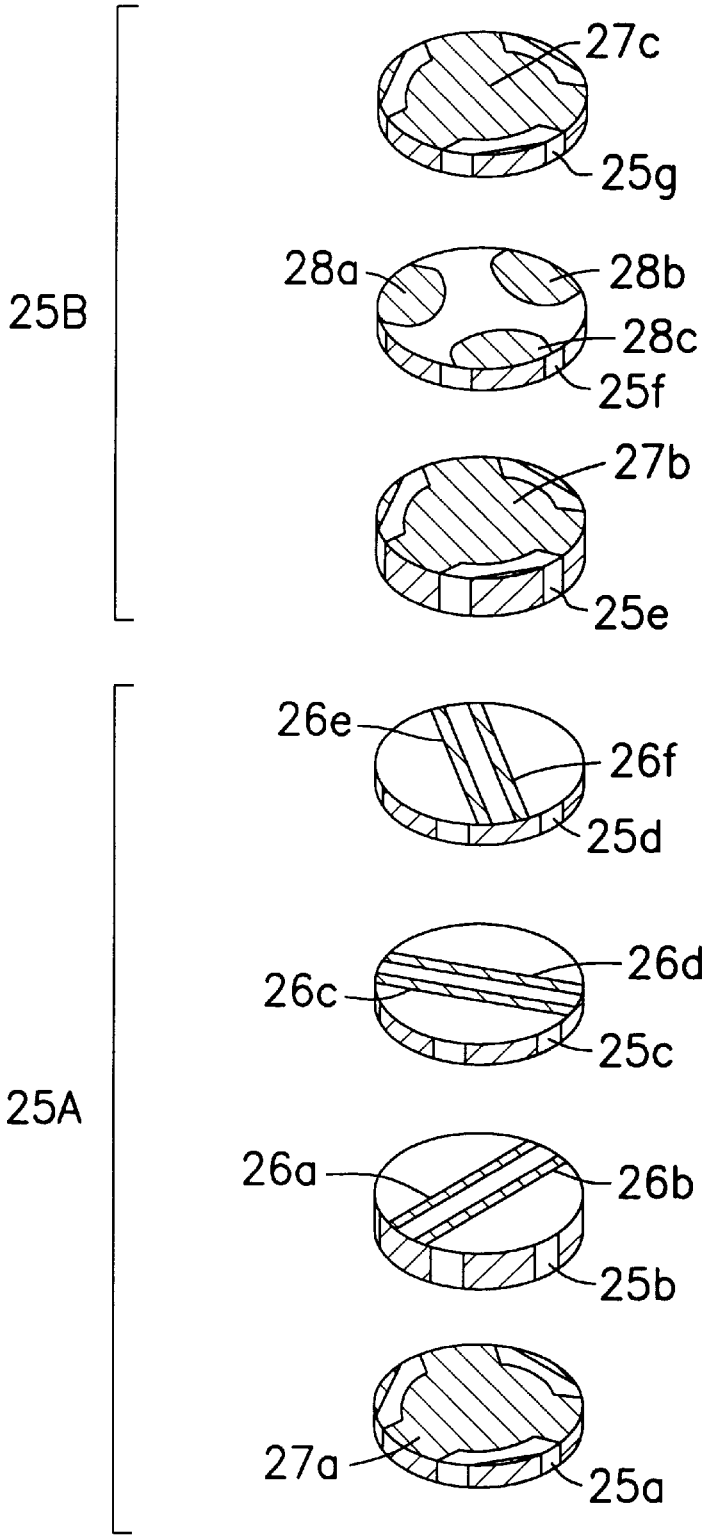
FIG. 7 is an exploded perspective view illustrating the ferromagnetic body used in the embodiment.

The central conductors and matching circuit formed in the ferromagnetic body 25 are described with reference to FIG. 7. FIG. 7 is an exploded perspective view of the ferromagnetic body 25.

The ferromagnetic body 25 has a structure in which ferromagnetic layers 25*a* to 25*g* are laminated and integrally fired. The ferromagnetic layers 25*a* to 25*d* constitute a first ferromagnetic body 25A, and the ferromagnetic layers 25*e* to 25*g* constitute a second ferromagnetic body 25B.

On the upper side of the magnetic layer 25*b* are formed central conductors 26*a* and 26*b*. Also, on the upper sides of the magnetic layers 25*c* and 25*d* are formed central conductors 26*c* and 26*d* and central conductors 26*e* and 26*f*, respectively. The central conductors 26*a* and 26*b* are parallel with each other. Similarly, the central conductors 26*c* and 26*d* are formed in parallel to each other, and the central conductors 26*e* and 26*f* are also formed in parallel to each other. Namely, in this embodiment, each central conductor extending in a given direction comprises a pair of central conductors, as described above.

The central conductors 26*a* and 26*b*, the central conductors 26*c* and 26*d*, and the central conductors 26*e* and 26*f* are arranged so as to cross each other in the vicinity of the center. Also the central conductors 26*a* and 26*b*, the central conductors 26*c* and 26*d*, and the central conductors 26*e* and 26*f* are arranged with the ferromagnetic layers 25*c* and 25*d*, respectively, therebetween, and thus electrically isolated.

On the upper surfaces of the ferromagnetic layers 25*a*, 25*e* and 25*g* are formed earth electrodes 27*a*, 27*b* and 27*c*, respectively. On the upper surface of the ferromagnetic layer 25*f* are formed three capacity electrodes 28*a*, 28*b* and 28*c*. The capacity electrodes 28*a* to 28*c* are opposed to the earth electrodes 27*b* and 27*c* through the ferromagnetic layers 25*f* and 25*g*, respectively, to form three capacitors.

The central conductors 26*a* to 26*f*, the earth electrodes 27*a* to 27*c* and the capacity electrodes 28*a* to 28*c* are formed by coating conductive paste on the upper surfaces of magnetic green sheets, laminating the green sheets, and then integrally firing the green sheets. Namely, the ferromagnetic body 25 comprises an integrally sintered compact.

Figure 8:
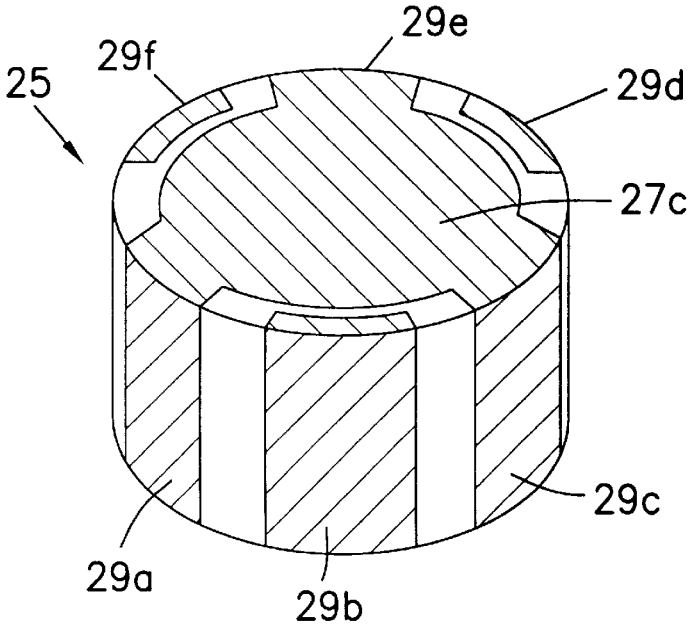
FIG. 8 is a perspective view illustrating the appearance of the ferromagnetic body used in the embodiment.

As shown in FIG. 8, on the side of the ferromagnetic body 25 are formed external electrodes 29*a* to 29*f*. The external electrodes 29*a*, 29*c* and 29*e* are connected to the earth electrodes 27*a*, 27*b* and 27*c*. The external electrode 29*a* is also connected to ends of the central conductors 26*a* and 26*b*. The external electrode 29*c* is connected to ends of the central conductors 26*c* and 26*d*. The external electrode 29*e* is electrically connected to ends of the central conductors 26*e* and 26*f*, i.e., the ends to be connected to the earth potential.

On the other hand, the external electrode 29*b* is connected to the other ends of the central conductors 26*e* and 26*f*. The external electrodes 29*d* and 29*f* are connected to the other ends of the central conductors 26*a* and 26*b* and the central conductors 26*c* and 26*d*, respectively.

Further, the external electrodes 29*b*, 29*d* and 29*f* are electrically connected to the capacity electrodes 28*c*, 28*b* and 28*a*, respectively.

Therefore, in the ferromagnetic body 25, the external electrodes 29*b*, 29*d* and 29*f* constitute portions to be connected to an input/output terminal, and the external electrodes 29*a*, 29*c* and 29*e* constitute connecting ends to be connected to the earth electrodes.

The external electrodes 29*a* to 29*f* are formed by coating conductive paste on the ferromagnetic body 25 obtained by integral firing, and then hardening or baking the conductive paste. Alternatively, the external electrodes 29*a* to 29*f* may be completed by laminating magnetic green sheets before firing, coating conductive paste on the side of the laminate and then integrally firing it to fire the magnetic material and bake the external electrodes 29*a* to 29*f*.

As described above, the ferromagnetic body 25 of this embodiment contains not only the plurality of central conductors 26*a* to 26*f* and the earth electrodes 27*a* and 27*b*, but also the capacity electrodes 28*a* to 28*c* and the earth electrode 27*c* for forming a matching circuit. Thus, there is no need for carrying out the troublesome work of joining the portion where the central conductors are arranged and the portion which the matching circuit is formed. Also the number of joints is decreased, and thus reliability is improved.

In addition, since the portion where the matching circuit is formed also comprises the ferromagnetic material, raw materials can be prepared by using the same line, and thus the matching circuit cost can be reduced.

Further, the saturation magnetization of the second ferromagnetic body 25B comprising the magnetic layers 25*e* to 25*g* is lower than the saturation magnetization of the first ferromagnetic body 25A comprising the magnetic layers of the portion where the central conductors are arranged, i.e., the magnetic layers 25*a* to 25*d*. Therefore, it is possible to reduce the magnetic material loss of the matching circuit.

Figure 9:
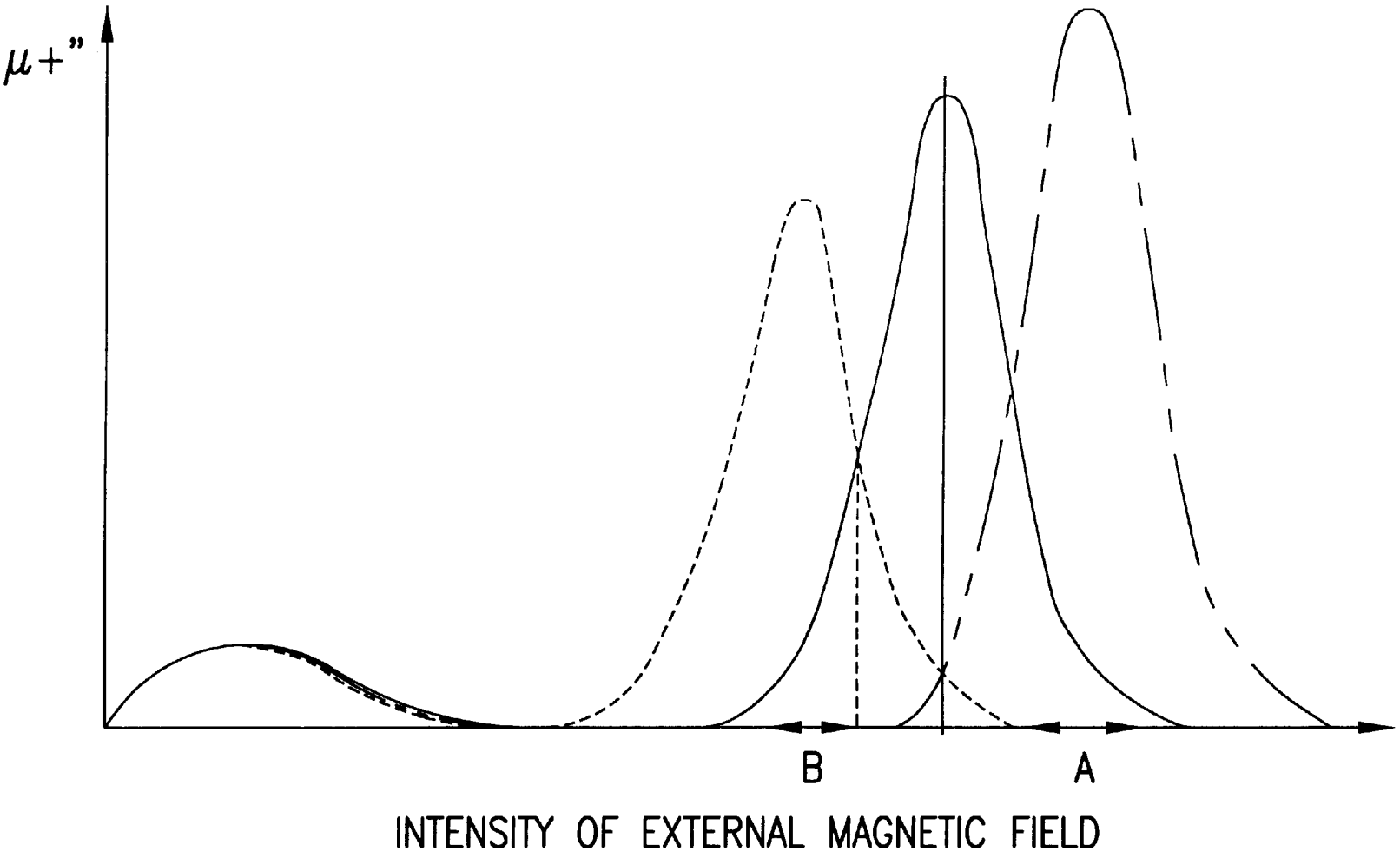
FIG. 9 is a drawing showing the relation between an external magnetic field and the imaginary part $\mu+$" of the permeability for a positive circularly polarized wave, for illustrating the reason why the magnetic loss is decreased in the nonreciprocal circuit device of the embodiment.

This will be described with reference to FIG. 9. FIG. 9 shows the characteristics of the imaginary part ($\mu+$") of the permeability for a positive circularly polarized wave to an external magnetic field. In FIG. 9, a solid line shows $\mu+$" of the magnetic body which constitutes the central conductors, and a broken line shows $\mu+$" of the ferromagnetic body with lower saturation magnetization which constitutes the matching circuit. Since the imaginary part of the permeability for a negative circularly polarized wave is close to zero, the magnetic material loss of the ferromagnetic material is proportional to the intensity of the imaginary part $\mu+$" of permeability for a positive circularly polarized wave.

On the other hand, a nonreciprocal circuit device is generally formed so as to operate in the region A shown in FIG. 9. Therefore, it can be found that since the saturation magnetization of the second ferromagnetic body which forms the matching circuit is made lower than the saturation magnetization of the first ferromagnetic body where the central conductors are arranged, the magnetic material loss of the matching circuit can be reduced.

In this embodiment, each of the first and second ferromagnetic bodies 25A and 25B comprises, for example, microwave ferrite such as yttrium iron garnet or calcium-vanadium garnet, represented by $Y_3Fe_{5-z}Al_zO_{12}$ or $\{Ca_{3-y}Y_y\}[Fe_2](Fe_{1.5+0.5y-z}Al_zV_{1.5-5y})O_{12}$ ($0<Z<1.0$, $0<Y<3.0$). The saturation magnetization of the second ferromagnetic body 25B can be decreased by relatively increasing the amount of Al (the Z value) in the microwave ferrite.

Although, in this embodiment, the saturation magnetization of the second ferromagnetic body is lower than the saturation magnetization of the first ferromagnetic body, the saturation magnetization of the second ferromagnetic body may be larger than that of the first ferromagnetic body. This also permits reduction in the magnetic material loss.

Namely, although a nonreciprocal circuit device is generally operated in the region A shown in FIG. 9, it can also be operated in the region B. In this case, the magnetic material loss can be decreased in a similar manner to the above embodiment, i.e., the magnetic material loss of the matching circuit can be decreased by making the saturation magnetization of the ferromagnetic body which forms the matching circuit larger than that of the first ferromagnetic body. It can thus be found that the $\mu$+" of the second ferromagnetic body which forms the matching circuit is as shown by a one-dot chain line in FIG. 9, and the magnetic material loss is decreased in the region B.

As described above, the saturation magnetization of either of the first and second ferromagnetic bodies may be increased. In both cases, the magnetic material loss of the matching circuit can be effectively reduced.

Figure 1:
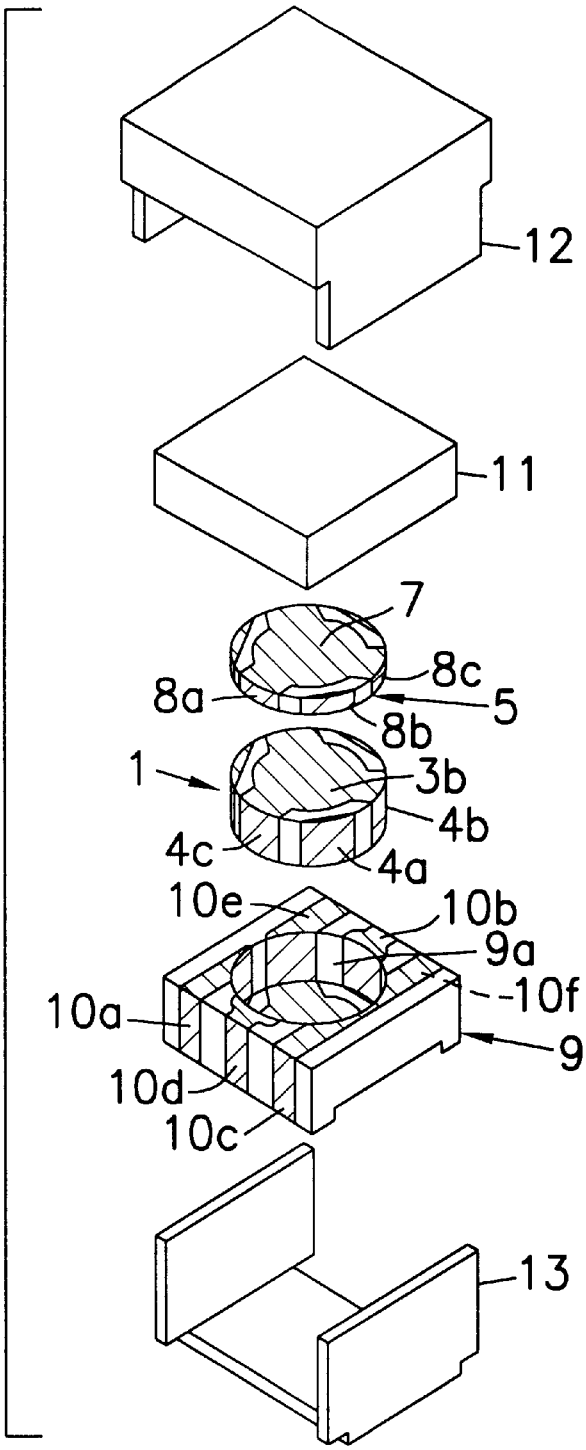
FIG. 1 PRIOR ART
FIG. 1 is an exploded perspective view illustrating an example of a conventional nonreciprocal circuit device.
Figure 2:
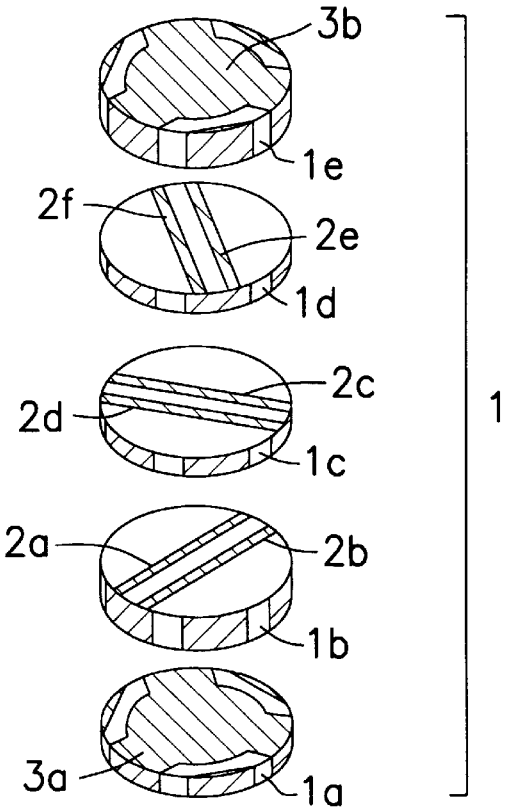
FIG. 2 PRIOR ART
FIG. 2 is an exploded perspective view of the ferromagnetic body shown in FIG. 1.
Figure 3:
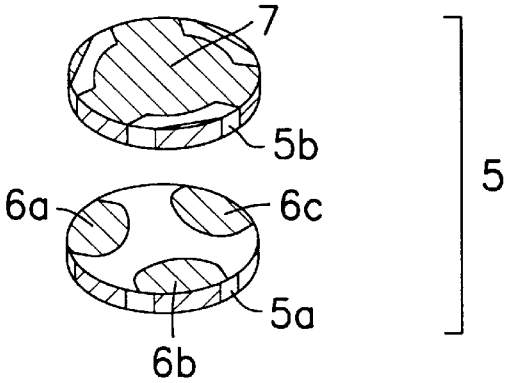
FIG. 3 PRIOR ART
FIG. 3 is an exploded perspective view illustrating the internal structure of the dielectric body shown in FIG. 1.

Returning to FIG. 6, the nonreciprocal circuit device of this embodiment comprises the ferromagnetic body 25 which is contained in the concave 9*a* of the terminal plate 9 and electrically connected to conductive patterns 10*a* to 10*f* formed on the terminal plate 9. Since the terminal plate 9 of this embodiment is the same as the terminal plate 9 shown in FIG. 1, the corresponding portions are denoted by corresponding reference numerals, and the description thereof is omitted.

On the ferromagnetic body 25 is fixed a permanent magnet 11. As the permanent magnet 11, an appropriate permanent magnet comprising ferrite or the like can be used.

Also metallic yokes 12 and 13, together with the permanent magnet, apply a magnetic field to the portion where the central conductors cross each other.

Although not shown in the drawings, the ferromagnetic body 25 may further comprise a magnetic circuit for applying a magnetic field to the portion where the central conductors cross each other. For example, a coiled conductive pattern may be integrally formed in the ferromagnetic body so that a magnetic field is generated by supplying the coiled conductive pattern with electricity.

Further, although, in this embodiment, each central conductor formed at a given level comprises a pair of central conductors, e.g., the central conductors 26*a* and 26*b*, as shown in FIG. 7, a single central conductor extending in a given direction at a given level may be provided.

Since the plurality of central conductors are formed in the first ferromagnetic body, and the matching circuit is formed in the second ferromagnetic body, dielectric materials which are fired under completely different firing conditions need not be used, and thus the firing conditions need not be greatly changed even when the first and second ferromagnetic bodies are fired separately. Also the number of the raw materials prepared can be reduced, and the manufacturing cost can thus be reduced.

Also, since the first and second ferromagnetic bodies have different saturation magnetizations, i.e., the saturation magnetization of the second ferromagnetic body is relatively decreased or relatively increased, the magnetic material loss of the matching circuit can be reduced. It is thus possible to provide a small, low-priced nonreciprocal circuit device having low insertion loss.

Further, when a magnetic circuit is integrally formed for applying a DC magnetic field to the first ferromagnetic body, means for applying a magnetic field to the central conductors can also be integrally provided, and a smaller nonreciprocal circuit device with excellent reliability can thus be provided.

Further, in a structure where plural pairs of capacity electrodes are provided to form the matching circuit, the capacity electrodes are formed on magnetic material green sheets and then fired. It is thus possible to easily form each of the capacitors for forming the matching circuit in the second ferromagnetic body by a ceramic firing technique.

Further, in a structure where the first and second ferromagnetic bodies are integrated by simultaneous firing, there is no need for the work of fixing the first and second ferromagnetic bodies, and thus a nonreciprocal circuit device having more excellent reliability can be obtained. Also, since the first and second ferromagnetic bodies need not be fired separately, the manufacturing process can significantly be simplified, and the same line can be used in the raw material preparing step, thereby significantly decreasing the manufacturing cost.

What is claimed is:

1. A nonreciprocal circuit device comprising:

a first ferromagnetic body;

a plurality of central conductors formed in the first ferromagnetic body and arranged to cross each other in an electrically isolated state;

a second ferromagnetic body fixed to the first ferromagnetic body; and a matching circuit formed in the second ferromagnetic body and electrically connected to the plurality of central conductors;

wherein the first and second ferromagnetic bodies have different saturation magnetizations.

2. A nonreciprocal circuit device according to claim 1, wherein the saturation magnetization of the second ferromagnetic body is smaller than that of the first ferromagnetic body.

3. A nonreciprocal circuit device according to claim 1, wherein the saturation magnetization of the second ferromagnetic body is larger than that of the first ferromagnetic body.

4. A nonreciprocal circuit device according to any one of claims 1 to 3, further comprising a magnetic circuit for applying a DC magnetic field to the first ferromagnetic body.

5. A nonreciprocal circuit device according to claim 1, wherein the matching circuit has a plurality of pairs of capacity electrodes which are formed with magnetic material layers of the second ferromagnetic body therebetween, and each capacitor comprising a respective pair of capacity electrodes is electrically connected to a corresponding one of the plurality of central conductors.

6. A nonreciprocal circuit device according to any one of claims 1 to 3, wherein the first and second ferromagnetic bodies comprise integrated and cofired magnetic material.

* * * * *